US005397483A

United States Patent [19]

Porter et al.

[11] Patent Number: 5,397,483

[45] Date of Patent: Mar. 14, 1995

[54] COMPOSITION FOR SIZING TEXTILES AND PROCESS USING SAME

[75] Inventors: Rick A. Porter, Woodruff; James M. Self, Taylors, both of S.C.

[73] Assignee: ABCO Industries, Roebuck, S.C.

[21] Appl. No.: 75,951

[22] Filed: Jun. 11, 1993

[51] Int. Cl.[6] ..... D06M 11/17

[52] U.S. Cl. ..... 252/8.8; 252/8.6; 427/331; 8/115.6; 8/115.68; 8/115.69

[58] Field of Search ..... 252/8.6, 8.8; 106/287.17; 8/115.6, 115.68, 115.69; 427/487, 331

[56] References Cited

U.S. PATENT DOCUMENTS 4,699,663 10/1987 Feeney, III ..... 8/115.6

5,145,522 9/1992 Nakagawa et al. ..... 106/287.17

*Primary Examiner*—Mark L. Bell

*Assistant Examiner*—C. M. Bonner

*Attorney, Agent, or Firm*—Dority & Manning

[57] ABSTRACT

A composition and process for formulating a size and for sizing and desizing textiles using an inorganic compound are provided. One inorganic compound that may be used is basic aluminum chloride. The use of basic aluminum chloride in a size formulation creates a size that is less environmentally hazardous but effective as a size.

24 Claims, No Drawings

COMPOSITION FOR SIZING TEXTILES AND PROCESS USING SAME

FIELD OF THE INVENTION

A composition and process for sizing textiles using an inorganic compound that is environmentally safe and an accompanying desizing process are provided.

BACKGROUND OF THE INVENTION

The manufacture of fabrics and textiles is a complex process. Generally speaking, fabrics are produced from yarns. A yarn is a continuous, often plied, strand composed of either natural or man-made fibers or filaments. In constructing a fabric, yarns are fed to a loom where they are weaved together. In the loom, the longitudinal yarns are called warp while the transverse yarns are called filling. Modern looms operate at high speeds, stretching the warp. In order to strengthen the warp, to reduce friction between the warp and the loom, and to increase weavability, the warp is pretreated with a sizing material. The sizing material is applied to the yarn by a slasher. Sizing materials are adhesive liquids that penetrate yarn pores forming a film on the outer diameter of the yarn. The size fills the pores and thus reduces absorption of subsequently applied adhesives or coatings. The size creates smooth surfaces by laying down projecting fibers and creates sufficient strength to resist the strains of weaving by fastening the fibers together. After applying the size, however, the yarn must remain flexible enough to be woven. An ideal size will eliminate loom warp stops and, at the same time, add to the overall quality of the fabric.

An effective size formula must impart several basic characteristics to a yarn in order to reduce warp breaks during weaving.

Perhaps the most important property of a warp yarn is the longitudinal breaking strength or tensile strength. Also important is the tearing strength or, in other words, the strength of the yarn in the perpendicular direction. The yarn must be strong enough to withstand the tension exerted on it by the loom. A size increases the strength of a yarn by cementing fibers together and by adding a film to the outside diameter of the yarn.

Although yarn strength is important, it is also critical that the yarn remain flexible. Consequently, the size must create an adhesive coating on the yarn that is pliable. Flexibility is important during weaving operations when the yarn is threaded over and around other yarn. During weaving, the yarn is repeatedly bent in many directions. If the yarn were not flexible, it may snap or break during operation of the loom. If the film formed by the size were not flexible, it may rupture and shed during weaving, thus creating weak spots in the yarn, increasing friction between the yarn and the loom, and create dusting which could decrease the efficiency of the machinery.

Two indicators of flexibility are elongation and elasticity. Elongation is a measure of the amount of stretch a yarn will undergo before it breaks. Elasticity gauges the ability of the yarn to return to its original length after being stretched. Flexibility, elongation and elasticity can be increased by maintaining moisture in the sized yarn. Moisture retention can be controlled by adding a humectant to the size solution, by not overdrying the yarn after it has been sized and by weaving under humid conditions. However, the sizing formula still prevails in determining the overall flexibility of the sized yarn.

Another important property of a sized yarn is its ability to weave without creating high friction between yarns and between the yarn and the machinery. The coefficient of friction of warp yarn is highly dependent on the properties of the size film. High friction will inevitably lead to shedding and yarn breaks. Friction can be reduced if the size can lay down projecting fibers of the yarn during formation of the film. If projecting fibers are present, they will shed off on the loom, creating fuzz balls or lint buttons.

In order to create a yarn with the basic characteristics as discussed above, the size formula must exhibit certain properties. For instance, the size must be adhesive to yarn. Adhesion is not only necessary for cementing fibers together, but is also important for the film to adhere to the yarn. The sizing agent must also adhere uniformly to the yarn. Film consistency ensures uniform strength over the length of the yarn.

Another property of the size to consider is its ability to penetrate the yarn during application. Penetration must be strictly controlled during processing. If the size does not penetrate the yarn sufficiently, the film will not adhere adequately. On the other hand, if the size penetrates and soaks the entire yarn diameter, the resulting warp will be too stiff.

Directly related to penetration is the viscosity of the size formula. Low viscosities lead to excessive penetration which results in stiffness and poor film forming ability. The viscosity or thickness of the size formula should be such that a proper film forms that is capable of laying down the projecting fibers. Thickening agents can be added to the sizing agent in order to increase viscosity.

Another important consideration is the removability of the size. Once yarn has been sized and woven, the fabric must be desized. A size, therefore, must be easily removable from the yarn. Desizing solutions are often expensive, and may harm the fabric.

Spent desize solution is usually discharged to a wastewater stream which is treated and then released to the environment. The wastewater stream is subject to environmental regulation. Recently, the federal government has set much more stringent standards and discharge limits. A size formula which can have an adverse impact on the environment may create a large cost to the discharger for treatment and disposal. For example, in 1980, a large textile mill reported wastewater treatment operating expenses of over $200,000.

Typical wastewater pollutants resulting from sizing agents include biological oxygen demand (BOD), chemical oxygen demand (COD), and aquatic toxicity. BOD is measured by an empirical test in which standardized laboratory procedures are used to determine the relative oxygen requirements of wastewater. The test measures the oxygen required for the biochemical degradation of organic material and the oxygen used to oxidize inorganic material such as sulfides and ferrous iron. COD, which is related to BOD, is a measure of the oxygen equivalent of the organic matter content of a sample that is susceptible to oxidation by a strong chemical oxidant. For BOD and COD, the higher the test result, the greater the pollutant.

Pollution has become a primary concern when formulating a size. Recently, a substantial amount of research and development has focused on finding a size formula that is less environmentally hazardous. Choosing an environmentally safe size would not only result in substantial savings to the manufacturer but would also be very beneficial to the environment.

A size formula can contain many ingredients and additives. The formulation of the size depends mostly on the fibers being treated. However, each size formula contains a base material, or a sizing agent, that is selected principally for its film forming ability. If other additives are added to the size, the sizing agent must be compatible with them. Incompatibility could result in the presence of precipitates or in-phase separation of the size solution thereby causing poor results.

The most popular known sizing agents include starches, carboxymethyl cellulose, polyvinyl alcohol (PVA) and mixtures thereof. Starch is a carbohydrate, synthesized within plants by combination or polymerization of dextrose. Physical properties such as pH, viscosity, moisture content, adhesiveness and film forming ability may vary from each source and supply. Starches also can be chemically modified. Specifically, starches can be acid modified, ethoxylated or oxidized. Starch, in granular form, is insoluble in cold water but produces a uniform viscous fluid when heated beyond a certain critical temperature. The viscosity of a starch and water mixture varies with temperature, and the difference in viscosity with rise in temperature is characteristic of each starch. The term "starch" is used herein as a generic term to describe all types of starch in general, unless otherwise denoted. Starches are relatively inexpensive. However, starches have a limited shelf life and usually require the above-described chemical modification in order to be compatible with other sizing agents and additives. Starches also tend to add a lot of weight to the treated yarn. The largest drawback to using starch, however, is its high BOD and COD.

Carboxymethyl cellulose is made from cellulose derived from wood pulp that is impregnated with sodium hydroxide to form alkali cellulose. This product is then combined with sodium monochloroacetate to form sodium carboxymethyl cellulose. Several types and grades of carboxymethyl cellulose can be produced. Carboxymethyl cellulose can create a tough film that retains water and is, therefore, flexible. However, carboxymethyl cellulose is more expensive than starch and frequently causes pollution problems in the waste stream.

PVA is a synthetic polymer resin. PVA can produce a stronger yarn with greater elongation and lower stiffness. However, because it is a petroleum-based product, PVA tends to be relatively more expensive than other sizing agents. Although lower than starch or carboxymethyl cellulose, the BOD and COD values for PVA can be high. PVA is often used in combination with starch.

Excessive BOD and COD effluents from mills must be reduced to protect the environment. Among the most commonly used textile size materials are starch, PVA and carboxymethyl cellulose which have high BOD and COD values. Some common size materials have the BOD's listed below:

TABLE IV

FIVE-DAY BODs OF SIZE MATERIALS

| SIZE MATERIAL | BOD (ppm) |
|---|---|
| Ahco nylon warp size | 340,000 |
| B-2 gum (starch dextrins) | 610,000 |
| Brytex gum 745 (starch) | 610,000 |
| Carboxymethyl cellulose (CMC) | 30,000 |

TABLE IV-continued

FIVE-DAY BODs OF SIZE MATERIALS

| SIZE MATERIAL | BOD (ppm) |
|---|---|
| Elvacet (polyvinyl acetate, PVAc) | 10,000 |
| Elvanol (PVA) | 10,000 to 16,000 |
| Globe Easyflow starch | 650,000 |
| Hydroxyethyl cellulose (HEC) | 30,000 |
| KD gum (starch) | 570,000 |
| Keofilm No. 40 (starch) | 550,000 |
| Morningstar starch | 470,000 |
| Nicol starch | 570,000 |
| Pearl (cornstarch, No. 173 and PT) | 500,000 |
| Penrod Gum 300 (starch ether) | 360,000 |
| RTC gum (starch-urea) | 120,000 |
| Starch No. 450 | 460,000 |
| Sodium alginate | 360,000 |
| Wheat starch | 550,000 |
| Ambertex M (starch paste) | 20,000 |

Although various agents have been employed to size yarn, the particular features of the present invention have not heretofore been known. The prior art is generally deficient in affording an economical and effective sizing agent that is environmentally safe. The present invention overcomes the shortcomings of the prior art in that the composition and process disclosed herein result in an effective sizing agent for yarns that is environmentally safe for later desizing and discharging operations.

SUMMARY OF THE INVENTION

It is an object of the present invention to provide a composition for sizing yarns.

It is an object of the present invention to provide a composition for sizing yarns that is environmentally safe.

It is another object of the present invention to provide a process for sizing yarns.

It is another object of the present invention to provide a sizing agent for yarns that is an inorganic film forming composition.

It is a further object of the present invention to provide a method of desizing yarns that have been sized with an inorganic sizing agent.

It is further another object of the present invention to provide an inorganic sizing agent that can be used in conjunction with other ingredients and additives.

It is a further object of the present invention to provide a sizing composition for the textile industry that is economical to use.

Generally speaking, the present invention is directed to a composition and process for sizing yarn in the textile industry, as well as a method of desizing the fabric. The sizing agent is an inorganic compound that is environmentally safe. The size may be removed by desizing according to a novel process described herein.

Broadly speaking, the present invention comprises a film-former where one example is basic aluminum chloride (BAC). BAC is an inorganic compound with the chemical formula, $Al_2(OH)_5Cl$. BAC is also known as aluminum chlorohydrate and is often available in solution form having the formula $Al_2(OH)_5Cl.\ 2.5\ H_2O$. One supplier is Reheis, Incorporated which distributes BAC under the tradename CHLORHYDROL TM. BAC has been found in the present invention to be an inorganic film-former that is an effective, economical and environmentally safe sizing agent. In fact, the BOD and COD for BAC is zero.

DESCRIPTION OF THE PREFERRED EMBODIMENT

The composition and process of the present invention is directed to the use of an inorganic film-former, such as BAC, as a sizing agent and a process for desizing material sized with the film-former. As a size, BAC can be used alone or in conjunction with other ingredients. By way of example only, the BAC is preferably blended with other ingredients. The ingredients added and their relative proportions primarily depend upon the particular fibers being treated. Before adding water, the BAC can be present from about 10% to about 100% by weight in the blend. The blend preferably also includes a film strengthening agent such as PVA in an amount up to about 90% by weight. In one embodiment, when sizing a cotton fabric, the quantity of BAC is about 50 weight percent while the quantity of PVA is about 30 weight percent. The blend can include chelating agents, latent bases if the yarn is prone to acid tendering, lubricants and thickening agents. In one embodiment for treating cotton fibers, the chelating agent is ethylene diamine tetra acetic acid (EDTA) and comprises about 1 weight percent of the blend. The latent base in this embodiment is urea at about 5 weight percent, the lubricant is hydrogenated tallow glyceride at about 6.5 weight percent, and the thickening agent is guar gum at about 7 weight percent. Water is added to the blend preferably to give 8 to 15 percent solids as is well known in the art. The mixture is cooked, where it is heated to about 165° F. A binder can be added after the cook. Preferred binders include acrylic copolymers with a copolymer containing the acetic acid salt of dimethyl amino ethyl methacrylate at 20% solids being one example. The binder is added in a quantity of about 3 to 5 weight percent of the entire size solution. The size is then ready to be applied. Although the specific percentages and process parameters described herein are preferred, other percentages and parameters may be utilized. The parameters will change when applying the size formula to different types of fibers.

In the textile industry, those skilled in the field believed inorganic compounds could not be used in size solutions. However, BAC has unexpectedly been found to be an effective sizing agent. Specifically, the belief was that inorganics as sizes would not produce a yarn that was supple or flexible enough for the weaving process.

Besides the above belief, three properties of BAC tend to make it an even more unlikely choice as a sizing agent to one of ordinary skill in the art. First, BAC is a Lewis acid; second, BAC is cationic; and third, BAC is in equilibrium with free aluminum ions. In most sizing applications, one or more of these properties must be addressed. However, in certain applications, no modifications or additives to the BAC sizing formulation are required to achieve formation of the sizing film.

As a Lewis acid, BAC hydrolyzes polysaccharides such as starches, gums, and cellulose which results in lowering of the viscosity of the size. As explained above, generally speaking, higher viscosities are preferred. Known sizes frequently contain starch and cellulose chemically modified by formation of methyl, ethyl, and more complex ethers such as those formed with ethylene and propylene oxides, or chloracetic acid. Polysaccharide gums are also found as film and viscosity modifiers in sizes. Such gums include guar bean, alginate and others. The gums may appear in their natural state or may be modified by etherification. Polysaccharides can be used with BAC in a size but the formulation of the size must account for the acidic nature of BAC.

The acidity of BAC can also cause acid tendering of cotton, viscose rayon fabric or flax which results in strength loss of the fibers. Acid tendering is a concern when treating fibers containing cellulose but can be minimized by inclusion of a latent base. However, the base must be weak, or localized elevation of the pH will cause the soluble BAC to convert into insoluble aluminum hydroxides. This flocculate binds to the fibers and is difficult to remove without substantial fiber damage. Further, the hydroxide precipitate produces fabrics of unacceptable stiffness. One latent base found to provide acceptable protection of cotton fibers without formation of aluminum hydroxide is urea. Urea also acts as a humectant. Of course, other weak Lewis bases that behave similarly, such as ammonia or amines, could also be employed.

The cationic nature of BAC also has to be taken into account. Conventional size formulations contain binders that are anionic such as diethylene glycol phthalates. Binders are used to promote adhesiveness. Anionic binders are flocculated by the cationic character of BAC and, as such, are incompatible. Other anionic adhesion promoters or viscosity control agents in sizes would likewise be incompatible. Among these are acrylic copolymers and acrylamide polymers. Although the latter are considered non-ionic, even small levels of hydrolysis leads to sufficient anionic character to make these polymers incompatible.

The use of cationic or non-ionic binders, adhesion promoters or viscosity control agents eliminates the compatibility problem. Examples of cationic binders include acrylic copolymers with an acrylic copolymer containing the acetic acid salt of dimethyl amino ethyl methacrylate at 20% solids being only one example.

The free aluminum ions present in equilibrium with BAC may slow the dissolving process and increase lump formation in the size. The ions also form salts of limited solubility with anionic species. This problem can be overcome with the addition of a chelating agent to complex the stray aluminum ions. Examples of a chelating agent are ethylene diamine tetracetic acid (EDTA) and citric acid.

Other substances can also be added to a size formulation containing BAC in order to enhance its effectiveness. For instance, BAC can be used in conjunction with other sizing agents such as starch and PVA. Starch and PVA act as film strengthening agents. Also, a lubricant may be added to the size to reduce friction between the yarns and between the yarns and the metal parts of the weaving machine. Lubricants include fats, oils, and waxes. Common lubricants used are hydrogenated tallow glyceride, mineral oil, corn oil, linseed oil, neatsfoot oil, and paraffin wax.

Humectants can also be added to improve flexibility and decrease brittleness of the film by absorbing water from the air which in turn plasticizes the film. Some lubricants act as effective humectants. Consequently, humectants also include fats, oils, and waxes. One common humectant is glycerin.

Another possible additive to the BAC size formulation is a thickening agent or a viscosity control agent as mentioned above. Thickening agents can be added in order to increase viscosity for improved application to the yarn. Natural gums are most commonly used as thickening agents and include guar gum, cellulose ethers, alginates and kelgins. The gums can also be modified by etherification before addition. Further thickening agents include synthetics such as polyacrylamides, polyacrylates, polyurethanes and polyethers. However, anionic synthetics would normally not be compatible with BAC. Consequently, if a synthetic thickening agent is used with BAC, it most likely should be cationic or non-ionic.

After the size is applied and the yarn is woven, the fabric must be desized. In a typical desizing process, the fabric first enters a desize solution where most of the actual desizing occurs. From there, the fabric goes through a pad and then enters a "J" box where steam is applied. From the "J" box, the fabric encounters a multitude of desize washers which apply a hot rinse to the fabric. From the desize washers, the fabric enters a caustic saturator and then enters another "J" box and washer. The fabric then enters a bleach bath, is run through a pad, is steamed and then is put into another washer. In the washer, the pH is neutralized. After the washer, the fabric is dried and dyed.

When using BAC in the size, the desize bath must be an acidic solution with a pH around 4 or 5. Phosphate detergents, phosphate sequestrants and water softeners may not be used, because phosphates and high pH's will precipitate the size. Preferably, the bath will comprise an acid, such as acetic or citric, in a concentration of about 1 percent based on the total weight of the bath. A non-ionic wetter may also be added to the desize bath. Examples of these wetters are ethoxylated phenols, which are sold under the tradenames, TRITON NPX-101, TRITON-X405, IGEPAL-CO630, IGEPAL-CO897 and RODAFAC-630 by various manufacturers. The wetting agent is added at about 1 weight percent based on the weight of the bath.

The present invention may be better understood by reference to the following examples.

Example 1

A test was conducted to determine film strength and flexibility of size solutions. Different concentrations of PVA were blended with water and cooked. After cooking, the inorganic film-former BAC was added. The PVA used was ELVANOL® T-25 manufactured by E. I. dupont de Nemours and Company. Water was added so as to result in 10% total solids. Films were cast on mylar from the solutions at 150° F. to 160° F. The wet films were placed in a drying oven at approximately 230° F. for five (5) minutes. The films were then removed from the oven, cooled to room temperature (3–5 minutes) and tested for bend (positive and negative), adhesion and removability. For positive bend, the film is folded 180° forward onto itself and pinch creased. Under negative bend, the film is folded back 180° away from itself and pinch creased. The crease is rubbed with a fingernail to determine the relative adhesive characteristics of the film. The removability test is performed by running cold water over the mylar to determine whether the film will wash off in 30 seconds or less.

After these tests were conducted, the films were conditioned by placing them in a humidity-temperature cabinet for twenty-four (24) hours. The temperature in the cabinet was 75° F. while the relative humidity was 75%. After conditioning, the same tests were performed.

Table I contains the results of the tests. The marks on the table indicate the following results:

Good=+
Average=0
Poor=−

TABLE I

Test For Film Strength and Flexibility of BAC/PVA Solutions

| | | | | | | |
|---|---|---|---|---|---|---|
| Parts BAC (solids) | 0 | 20 | 40 | 60 | 80 | 100 |
| Parts PVA (solids) | 100 | 80 | 60 | 40 | 20 | 0 |
| Positive Bend | + | + | + | + | 0 | − |
| Negative Bend | + | + | + | 0 | 0 | − |
| Adhesion | + | + | + | 0 | 0 | 0 |
| Removability | − | 0 | + | + | + | + |
| After Conditioning | | | | | | |
| Positive Bend | + | + | + | + | + | − |
| Negative Bend | + | + | + | + | 0 | − |
| Adhesion | + | + | + | + | + | 0 |
| Removability | 0 | + | + | + | + | + |

Example 2

The same procedure was followed as described in Example 1 and the results are shown in Table 2. Instead of PVA, starch was tested with BAC. The specific starch tested was obtained from A. E. Staley Manufacturing Company.

TABLE II

Test For Film Strength and Flexibility of BAC/Starch Solutions

| | | | | | | |
|---|---|---|---|---|---|---|
| Parts BAC (solids) | 0 | 20 | 40 | 60 | 80 | 100 |
| Parts PVA (solids) | 100 | 80 | 60 | 40 | 20 | 0 |
| Positive Bend | 0 | 0 | 0 | 0 | 0 | − |
| Negative Bend | 0 | 0 | 0 | 0 | 0 | − |
| Adhesion | 0 | 0 | 0 | 0 | 0 | 0 |
| Removability | − | − | 0 | + | + | + |
| After Conditioning | | | | | | |
| Positive Bend | + | + | + | 0 | − | − |
| Negative Bend | + | + | + | 0 | 0 | − |
| Adhesion | + | + | + | 0 | 0 | 0 |
| Removability | − | 0 | 0 | + | + | + |

Example 3

The same procedure was followed as described in Example 1. Here, BAC was tested with a mixture of PVA and starch. The results are contained in Table III.

TABLE III

Test For Film Strength and Flexibility of BAC, PVA and Starch Solutions

| | | | | | | |
|---|---|---|---|---|---|---|
| Parts BAC (solids) | 20 | 40 | 60 | 80 | 60 | 40 |
| Parts PVA (solids) | 20 | 20 | 20 | 10 | 10 | 10 |
| Parts Starch (solids) | 60 | 40 | 20 | 10 | 30 | 10 |
| Positive Bend | − | − | − | − | − | − |
| Negative Bend | − | − | − | − | − | − |
| Adhesion | − | − | − | − | − | − |
| Removability | − | 0 | + | + | + | 0 |
| After Conditioning | | | | | | |
| Positive Bend | + | + | 0 | 0 | − | + |
| Negative Bend | + | + | 0 | 0 | − | + |
| Adhesion | + | + | 0 | − | 0 | + |
| Removability | 0 | + | + | + | + | + |

Example 4

The same procedure was followed as described in Example 1. Here, BAC was mixed with glycerin and urea in the proportions shown. The film produced was not conditioned but was dried. Table 4 contains the results.

TABLE IV

| Test For Film Strength and Flexibility of a BAC, Glycerin and Urea Solution at 10% Solids | |
|---|---|
| Parts BAC (solids) | 85 |
| Parts Glycerine (solids) | 10 |
| Parts Urea (solids) | 5 |
| Positive Bend | + |
| Negative Bend | + |
| Adhesion | + |
| Removability | + |

This example demonstrates how BAC can be used without the addition of other film strengthening agents. Urea was added as a latent base and glycerin was added as a humectant.

Example 5

As discussed above, because BAC is a Lewis acid. Acid tendering can occur in some fibers which reduces their strength. A test was conducted to show how the addition of a latent base into a size containing BAC improves the tensile strength of the yarn. The particular latent base used here was urea but the present invention is not so limited.

Different concentrations of urea were added to the following size:

| Parts | Additive |
|---|---|
| 700 | Water |
| 50 | PVA (24 cP @ 4% 25° C., 96% hydrolyzed) |
| 25 | BAC |
| 5 | Hydrogenated Tallow Glyceride (lubricant) |

After adding an amount of urea, a 50/50 polyester and cotton blend fabric was padded with the size. The fabric samples were dried 3 minutes at 300° F. and exposed to 80% relative humidity at 50° C. for 8 days. Grab breaks were run in a 3-inch gauge by 1-inch jaw to determine tensile strength. A control not exposed to the size solution was also tested. Table V contains the results of the tests. "-" indicates the fabric failed at the jaw and, was, therefore, discarded as a failed test.

TABLE V

| Grab Strength Of A Polyester/Cotton 50/50 Blend Using A BAC Size With Varying Concentrations Of Urea* | | | | | |
|---|---|---|---|---|---|
| No. | Untreated | 0 Parts | 5 Parts | 10 Parts | 20 Parts |
| 1 | 1137 | 985 | 1215 | 1220 | 1160 |
| 2 | — | 912 | 1110 | 1145 | 1125 |
| 3 | 1080 | — | 1200 | 1200 | 1060 |
| 4 | — | 1065 | 1198 | 1155 | 1205 |
| 5 | 1090 | | | | |
| 6 | 1022 | | | | |
| 7 | 1223 | | | | |
| 8 | 1103 | | | | |
| Avg.: | 1109 | 987 | 1181 | 1180 | 1138 |

*In lbs. × $10^1$

Example 6

The same procedure and tests were run on a 100% cotton fabric as described in Example 5. The results are contained in Table VI.

TABLE VI

| Grab Strength Of A 100% Cotton Fabric Using A BAC Size With Varying Concentrations of Urea* | | | | | |
|---|---|---|---|---|---|
| No. | Untreated | 0 Parts | 5 Parts | 10 Parts | 20 Parts |
| 1 | 495 | 553 | 654 | 657 | 702 |
| 2 | 603 | — | 676 | 603 | — |
| 3 | 578 | 273 | 594 | — | 610 |
| 4 | 403 | 250 | 682 | 601 | 634 |
| 5 | — | 250 | 639 | 618 | 682 |
| 6 | 562 | | 543 | | |
| Avg.: | 528 | 332 | 631 | 620 | 657 |

*In lbs. × $10^1$

Example 7

As discussed earlier, the cationic nature of BAC can create incompatibility problems when used with anionic agents. This eliminates the use of many synthetics as adhesion promoters or viscosity control agents. One of these agents is polyacrylamide. Although polyacrylamide is considered non-ionic, even small levels of hydrolysis leads to sufficient anionic character which may make it incompatible with BAC.

A test was conducted to determine the compatibility of BAC and polyacrylamide in a size consisting of PVA, BAC, citric acid, urea and polyacrylamide. The citric acid was added as a chelating agent. After the size was formulated and cooked, incompatibility was determined by the presence of flocculent and precipitate. Polyacrylamide is generally not compatible with BAC. However, compatibility was discovered when polyacrylamide concentration was lower and urea concentration was higher. The results of that test are contained in Table VII, with "Y" indicating compatibility and "N" indicating the presence of a precipitate.

TABLE VII

| | Compatibility of Polyacrylamide with BAC | | | | | | | | | | | | | | | | | |
|---|---|---|---|---|---|---|---|---|---|---|---|---|---|---|---|---|---|---|
| No. | 1 | 2 | 3 | 4 | 5 | 6 | 7 | 8 | 9 | 10 | 11 | 12 | 13 | 14 | 15 | 16 | 17 | 18 |
| PVA 40%/BAC 60% | 67 | 67 | 67 | 67 | 67 | 67 | 67 | 67 | 67 | 67 | 67 | 67 | 67 | 67 | 67 | 67 | 67 | 67 |
| Citric Acid | 15 | 13 | 10 | 15 | 13 | 10 | 15 | 13 | 10 | 15 | 13 | 10 | 15 | 13 | 10 | 15 | 13 | 10 |
| Urea | 4 | 4 | 4 | 3 | 3 | 3 | 4 | 4 | 4 | 3 | 3 | 3 | 4 | 4 | 4 | 3 | 3 | 3 |
| Polyacrylamide | 10 | 10 | 10 | 10 | 10 | 10 | 7 | 7 | 7 | 7 | 7 | 7 | 3 | 3 | 3 | 3 | 3 | 3 |
| Compatible | N | N | N | N | N | N | Y | N | N | N | N | N | Y | Y | Y | N | N | N |

Example 8

A size formulation containing BAC was tested for effectiveness in a weaving operation of a cotton yarn. The ingredients of the size were as follows:

| Ingredient | Amount (Parts) |
|---|---|
| Water | 1870.0 |
| BAC | 150.0 |
| PVA | 100.0 |
| EDTA | 2.5 |
| Urea | 15.0 |
| Hydrogenated Tallow Glyceride | 20.0 |
| High Viscosity Guar Gum | 21.0 |

The above mixture was cooked at about 165° F. Seventy-eight parts of an acrylic copolymer containing the acetic acid salt of dimethyl amino ethyl methacrylate at 20% solids was then added as a cationic binder.

In the above size, EDTA acts as a chelating agent, urea as a latent base, hydrogenated tallow glyceride as a lubricant and the guar gum as a thickening agent. The size had a theoretical 13.58 percent solids.

The size was applied and run on a Style 2516 yarn which is 12.5 single ring spun cotton. The 67-inch wide warp had 7,200 total ends with a 2×1 left hand twill weave. The yarn was woven on a Tsudakoma air jet weaving machine running at 460 RPM. The size was run on a vertical West Point slasher. The slasher had 18 sixty-inch cylinders and two size boxes. There were 3,600 ends per size box drying on six cylinders individually before coming together for the final dry on the last six cylinders. There were 1,200 yards slashed. Along with the BAC size, a control size was run under the same conditions and following the same procedure. The control size was a conventional formula with the following ingredients (no BAC):

| Ingredient | Amount (Parts) |
|---|---|
| Water | 1870 |
| PVA | 165 |
| Ethoxylated corn starch | 120 |
| Hydrogenated tallow glyceride | 20 |

The mixture was cooked at about 180° F. Seventy-eight parts of diethylene glycol phthalate copolymer at 20% solids was then added as a binder. This particular binder is marketed by ABCO Industries under the name ABCOPAK 6045.

Table VIII contains the average results for a series of several runs.

TABLE VIII

| | Control Size | BAC Size |
|---|---|---|
| Warp Breaking Strength (Avg.) (Longitudinal Direction) | 97.00 lb. | 99.00 lb. |
| Filling Breaking Strength (Avg.) (Perpendicular Direction) | 75.00 lb. | 76.00 lb. |
| Warp Tear (Avg.) (Longitudinal) | 3.33 lb. | 3.52 lb. |
| Filling Tear (Avg.) (Perpendicular) | 3.05 lb. | 3.10 lb. |
| Warp Shrinkage % | −10.40 | −10.40 |
| Filling Shrinkage % | 3.30 | 3.30 |

As shown in Table VIII, the BAC size created a fabric with greater strength.

The yarn from the BAC size was woven for three days. The efficiency for Day One was 86.80% and for Day Two was 87.45%. The warp ran out after 5 hours into Day Three. The standard efficiency for Style 2516 is 85 percent.

Example 9

The fabric produced from Example 8 using the BAC size was desized as described above. Table IX lists the chemicals used to desize the fabric at specific points in the process.

TABLE IX

| Procedure For Desizing BAC Size | |
|---|---|
| 1. Desize Bath | |
| Acetic or Citric Acid | 1.0% wt. % |
| Non-ionic wetter (IGEPAL-CO897) (pH: 4.0-4.5) | 1.0% wt. % |
| Pad, steam, hot rinse | |
| 2. Caustisize (Caustic saturator) | |
| Pad, steam, hot rinse | |

TABLE IX-continued

| Procedure For Desizing BAC Size | |
|---|---|
| 3. Bleach Bath | |
| Sequestrant (EDTA) | 0.2% wt. % |
| Sodium Silicate (peroxide stabilizer) | 1.0% wt. % |
| Caustic (50%) | 1.0% wt. % |
| $H_2O_2$ | 3.0% wt. % |
| Pad, steam, hot rinse pH to neutral, dry. | |
| 4. Fabric ready for dyeing. | |

Conventional sizes lose approximately 20 to 25% strength on desizing and bleaching. Conventional sizes are desized in a alkaline bath containing phosphates.

It was also discovered that the BAC-sized fabric bleached whiter than conventionally sized goods. Greige strength on conventional and BAC sized goods were about the same. Absorbency of prepared fabric using the BAC size was much greater and fabric thickness, or "hand" after desizing was approximately 20% thicker using the BAC size.

Example 10

The control size and BAC size fabrics of Example 8 were desized. The BAC sized fabric was desized as described in Example 9. At different locations in the desizing process, the five-day BOD of the waste stream was tested. Specifically, the fabric went from a "J" box to three desize washers after leaving the desize bath. Samples were gathered at the "J" box (steamer) and at each of the desize washers. The results are contained in Table X. Referring to Table X, the process proceeds from the steamer to wash #3 to wash #2 to wash #1 and then to the waste stream.

TABLE X

BOD's of Desize Process

| | CONTROL SIZE | BAC SIZE | REDUCTION % |
|---|---|---|---|
| STEAMER | 5600 MG/L | 3925 MG/L | 30% |
| #3 wash | 1265 MG/L | 665 MG/L | 47% |
| #2 wash | 1117 MG/L | 547 MG/L | 51% |
| #1 wash | 802 MG/L | 555 MG/L | 31% |

Example 11

The samples gathered in Example 10 were also tested for COD. Table XI contains the results of those tests.

TABLE XI

COD's of Desize Process

| | CONTROL SIZE | BAC SIZE | REDUCTION % |
|---|---|---|---|
| STEAMER | 12,960 MG/L | 15,660 MG/L | +21% |
| #3 wash | 3,218 MG/L | 2,092 MG/L | 35% |
| #2 wash | 3,050 MG/L | 1,882 MG/L | 38% |
| #1 wash | 2,296 MG/L | 1,414 MG/L | 38% |

Again, COD values dropped considerably when using the BAC size. The reason for the high COD value for the BAC size at the steamer is not known. However, it was observed that the BAC size came off the yarn much easier than the control size. Consequently, much more BAC size was in solution at the steamer, which could explain the higher COD at the "J" box (steamer).

It should be understood that the present invention is not limited to the specific compositions or processes described herein and that any composition having a formulation or process steps equivalent to those described falls within the scope of the present invention. Preparation routes of the composition and process steps for sizing fibers to produce fabric are merely exemplary so as to enable one of ordinary skill in the art to make the composition and use it according to the described process and its equivalents. Parameters are especially susceptible to variation when employing different types of fibers. It will also be understood that although the form of the invention shown and described herein constitutes a preferred embodiment of the invention, it is not intended to illustrate all possible forms of the invention. Aspects of the various embodiments may be interchanged both in whole or in part. The words used are words of description rather than of limitation. Various changes and variations may be made to the present invention without departing from the spirit and scope of the following claims.

What is claimed is:

1. A method of sizing a textile material by treating said material with a size formulation wherein said size formulation comprises basic aluminum chloride.

2. The method as defined in claim 1, wherein said size formulation further comprises a Lewis base.

3. The method as defined in claim 1, wherein said size formulation further comprises a chelating agent adapted to complex free aluminum ions and prevent the formation of salts having limited solubility.

4. The method as defined in claim 3, wherein said chelating agent is ethylene diamine tetra acetic acid.

5. The method as defined in claim 1, wherein said size formulation further comprises a lubricant.

6. The method as defined in claim 1, wherein said size formulation further comprises a thickening agent for increasing the viscosity of said size formulation.

7. The method as defined in claim 2, wherein said Lewis base is urea.

8. The method as defined in claim 1, wherein said size formulation further comprises a film strengthening agent selected from the group consisting of polyvinyl alcohol, starches, carboxymethyl cellulose and mixtures thereof.

9. The method as defined in claim 1, wherein said size formulation further comprises a binder to provide better adhesion between said size formulation and said material.

10. The method as defined in claim 9, wherein said binder is a cationic acrylic copolymer.

11. The method as defined in claim 10 wherein said cationic acrylic copolymer is an acetic acid salt of a copolymer containing dimethyl amino ethyl methacrylate.

12. A method of sizing a material by treating said material with a size formulation wherein said size formulation comprises basic aluminum chloride, a thickening agent, a chelating agent, a film strengthening agent, and a binder for adhering said size formulation to said material.

13. The method as defined in claim 12 wherein said size formulation further comprises a weak Lewis base.

14. The method as defined in claim 12 wherein said thickening agent is selected from the group consisting of natural gums, synthetic gums, etherified versions and mixtures thereof; wherein said chelating agent is selected from the group consisting of ethylene diamine tetra acetic acid and citric acid; and wherein said film strengthening agent is selected from the group consisting of polyvinyl alcohol, carboxymethyl cellulose, and starch.

15. A size formulation for use in sizing operations wherein said size formulation comprises basic aluminum chloride, a thickening agent, a film strengthening agent, and a binder for adhering said size formulation to said material.

16. The size formulation as defined in claim 15 further comprising a chelating agent, a latent base, and a lubricant.

17. A method of preparing a composition for use in a textile sizing formulation which comprises blending basic aluminum chloride with a film strengthening agent, and a thickening agent for increasing viscocity.

18. The method as defined in claim 17, wherein said film strengthening agent is polyvinyl alcohol.

19. The method as defined in claim 17, wherein said thickening agent is guar gum.

20. The method as defined in claims 17 further comprising the step of blending a latent base into said composition.

21. The method as defined in claim 20, wherein said latent base is urea.

22. A method of treating a material by sizing said material with a size formulation, processing said material, and then desizing said material by treating said sized and processed material with a bath, wherein said size formulation comprises basic aluminum chloride and said bath has an acidic pH and comprises a non-anionic wetting agent.

23. A method of desizing a material that has been sized with a formulation containing basic aluminum chloride wherein the desizing composition comprises an acid for adjusting the pH of said desizing composition to below 7 and a non-anionic wetting agent.

24. The method as defined in claim 23 wherein said wetting agent is an ethoxylated alkyl phenol.

* * * * *